US005131882A

United States Patent [19]

Kiyokane

[11] Patent Number: 5,131,882

[45] Date of Patent: Jul. 21, 1992

[54] WHEELED TOY

[75] Inventor: Jerrilyn Kiyokane, Torrance, Calif.

[73] Assignee: Namkung Promotions, Inc., Costa Mesa, Calif.

[21] Appl. No.: 495,993

[22] Filed: Mar. 21, 1990

[51] Int. Cl.[5] ..... A63H 29/00; A63H 17/26; A63H 17/00

[52] U.S. Cl. ..... 446/464; 446/470; 446/431; 446/97; 446/76

[58] Field of Search ..... 446/464, 462, 457, 465, 446/469, 470, 471, 487, 431, 93, 94, 95, 96, 71, 75, 76, 77, 78, 69

[56] References Cited

U.S. PATENT DOCUMENTS

| | | | |
|---|---|---|---|
| 1,787,034 | 12/1930 | Burns | 446/78 |
| 3,120,719 | 2/1964 | Simonds | 446/78 |
| 3,154,882 | 11/1964 | Bossiere | 446/78 |
| 3,611,629 | 10/1971 | Foley etal. | 446/96 |
| 4,057,929 | 11/1977 | Ogawa | 446/462 X |
| 4,103,774 | 8/1978 | Shingyouchi | 446/75 X |
| 4,217,724 | 8/1980 | Schoenfield etal. | 446/96 X |
| 4,279,096 | 7/1981 | Guidry | 446/69 |
| 4,411,639 | 10/1983 | Rüther | 446/470 X |
| 4,450,650 | 5/1984 | Holden et al. | 446/94 |
| 4,648,487 | 3/1987 | Kimura | 446/464 X |

FOREIGN PATENT DOCUMENTS

| | | | |
|---|---|---|---|
| 0015217 | 9/1980 | European Pat. Off. | 446/464 |
| 8603985 | 7/1986 | European Pat. Off. | 446/94 |

*Primary Examiner*—Robert A. Hafer
*Assistant Examiner*—D. Neal Muir
*Attorney, Agent, or Firm*—James E. Brunton

[57] ABSTRACT

A circular or annular shaped rolling toy which can be designed to simulate the appearance of a circular or annular shaped product so that it can be used to promote the sale of the product. In one form of the invention, a small motor is provided to propel the toy.

1 Claim, 3 Drawing Sheets

WHEELED TOY

BACKGROUND OF THE INVENTION

1. Field of the Invention

The present invention relates generally to toys. More particularly, the invention concerns a rolling toy which includes a generally annular shaped body portion having wheels connected thereto for rotatably supporting the body.

2. Discussion of the Invention

Many products are annular or circular in shape. Such products include breath mints, donuts, tires, compact disks and the like. Frequently product manufacturers use toys as a medium for advertising their products. For example, a producer of an annular shaped candy or breath mint could promote its product by means of an annular shaped toy having the general outward appearance of the product and perhaps bearing the producers trademark. Similarly a fast food outlet selling hamburgers could promote its product by means of a generally circular shaped toy having the appearance of a hamburger.

The addition of wheels to the circular or annular shaped toy adds to the child appeal of the toy and increases its usefulness as a promotional item. By constructing the toy so that two more identical toys can be releasably interconnected, the promotional appeal of the device can be further enhanced. The inclusion of a small motor to drive the wheels of the toy still further enhances the promotional appeal of the toy.

SUMMARY OF THE INVENTION

It is an object of the present invention to provide a circular or annular shaped rolling toy which can be designed to simulate the appearance of a circular or annular shaped product so that it can be used to promote the sale of the product.

It is another object of the invention to provide a rolling toy of the forementioned character which can be coupled together with another identically configured rolling toy.

Another object of the invention is to provide a rolling toy of the character described which has a hollow body within which a small motor can be mounted to rotatably drive the wheels of the toy.

Still another object of the invention is to provide a toy of the character described in the preceding paragraphs which is of simple construction so that it can be inexpensively mass produced.

DESCRIPTION OF THE INVENTION

Figure 6:
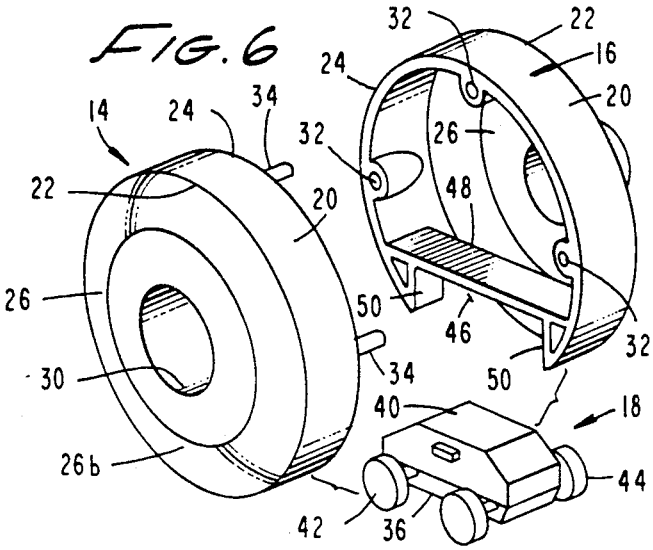
FIG. 6 is a generally perspective exploded view of the toy.

Referring to the drawings and particularly FIGS. 1 through 6, the rolling toy of the present invention comprises a hollow body 12 including first and second portions 14 and 16 (FIG. 6), means for interconnecting first and second portions 14 and 16 and roller means, generally designated in FIG. 6 by the numeral 18, for rollably supporting body 12.

Figure 1:
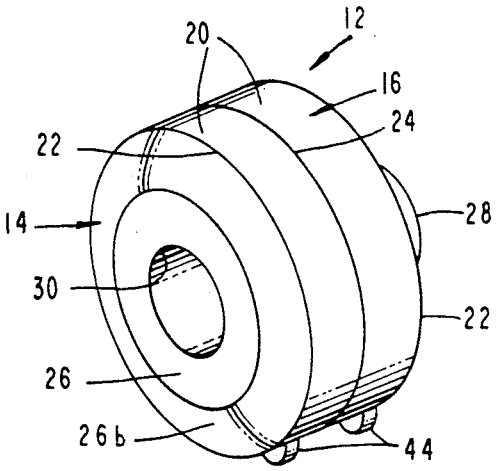
FIG. 1 is a generally perspective view of the wheeled toy of the present invention.
Figure 2:
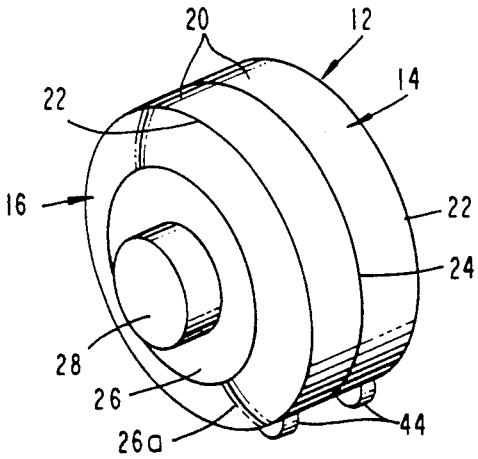
FIG. 2 is a generally perspective view of the toy similar to FIG. 1 but showing the opposite side of the toy.

Each body portion 14 and 16 includes peripheral walls 20 having spaced apart first and second edges 22 and 24 respectively. A closure wall 26 is connected to each edge portion 22. Walls 26 are generally circular shaped and one closure wall, designated by the numeral **26*a* in FIG. 2, is a centrally disposed, outwardly protruding hub 28. As best seen in FIG. 1, the closure wall designated by 26*b* is provided with a centrally disposed socket 30. In a manner presently to be described, two toys can be interconnected together by inserting the hub 28 of one toy into the socket 30** of another toy.

Turning now to FIG. 6, edge 24 of body portion 16 is provided with a plurality of circumferentially spaced apertures 32. Apertures 32 are adapted to closely receive outwardly extending connector members 34 provided on edge 24 of body portion 14. Connector members 34 are adapted to be closely received within apertures 32 and comprise the means for interconnecting portions 14 and 16 of body 12.

Figure 7:
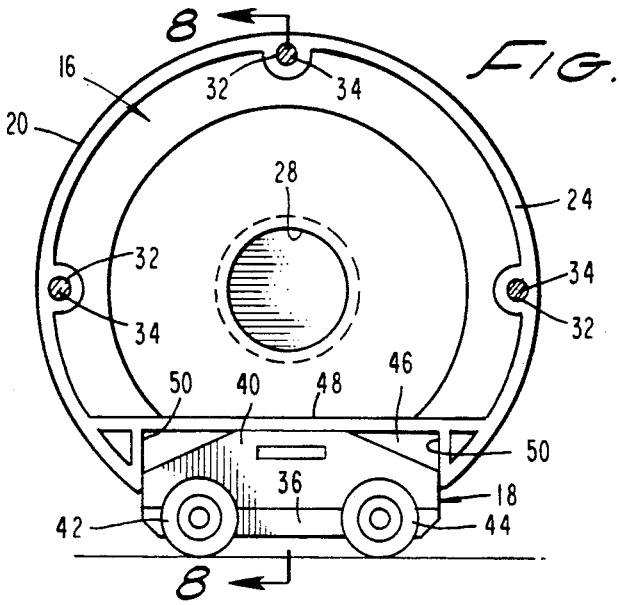
FIG. 7 is an enlarged side elevational view taken along lines 7—7 of FIG. 4.
Figure 9:
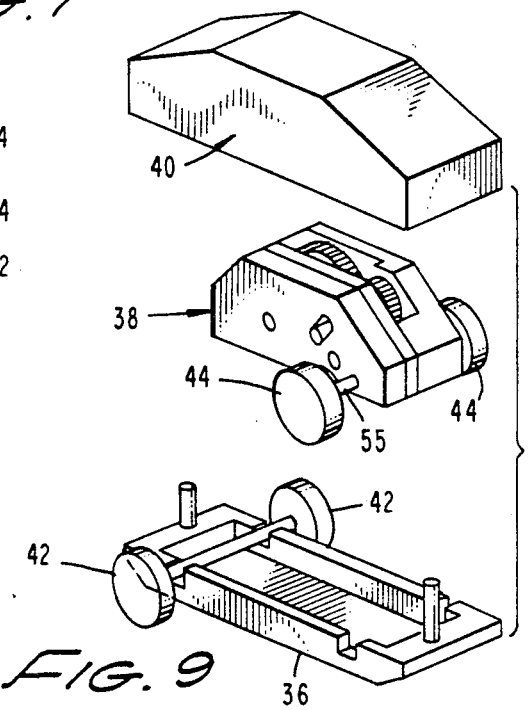
FIG. 9 is a generally perspective exploded view of the driving mechanism of the toy.
Figure 8:
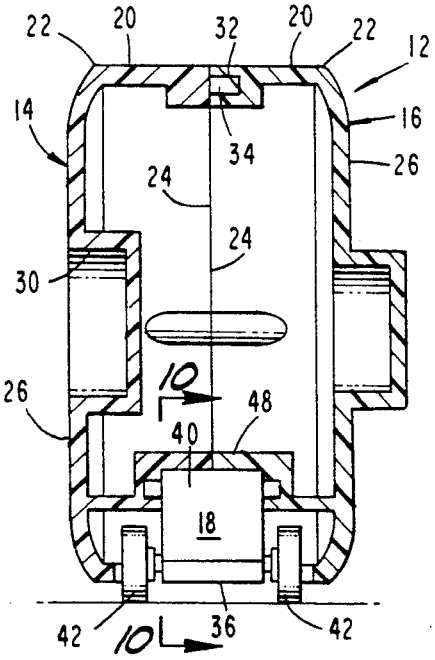
FIG. 8 is a cross-sectional view taken along lines 8—8 of FIG. 7.
Figure 11:
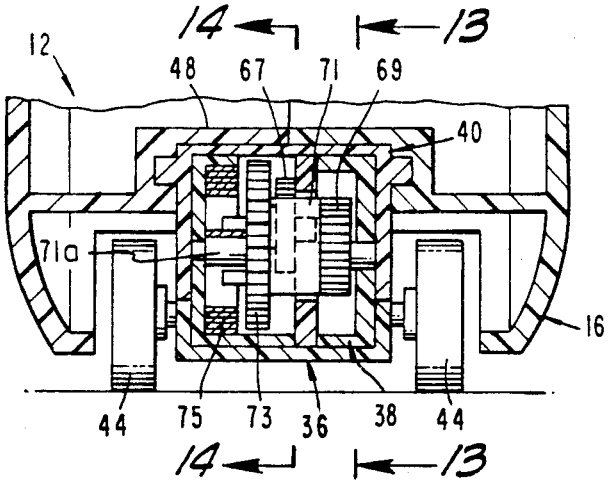
Figure 11 is a cross-sectional view taken along lines 11—11 of FIG. 10.
Figure 10:
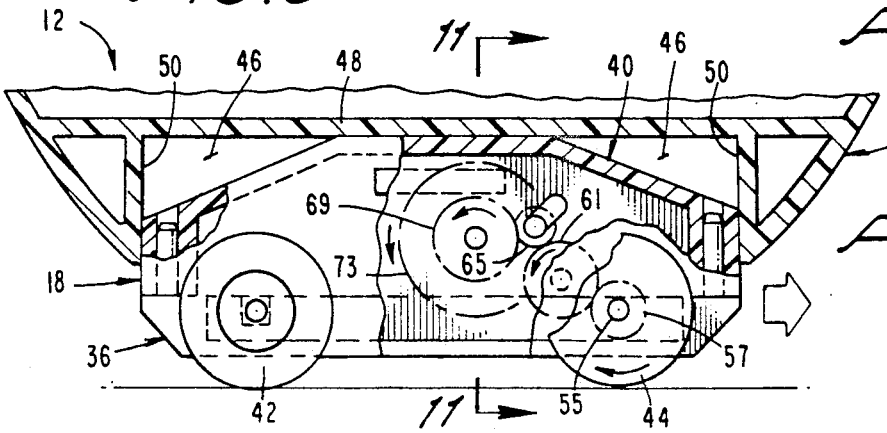
FIG. 10 is an enlarged cross-sectional view taken along lines 10—10 of FIG. 8.

Referring now FIG. 9, the roller means of the present embodiment of the invention comprises a carriage or base 36, a motor unit 38 carried by base 36, and a cover 40 which encapsulates motor unit 38 and is releasably connected to base 36. A pair of spaced apart wheels 42 are rotatably carried proximate one end of base 36. Motor unit 38 also carries a pair of spaced apart wheels 44 which are located proximate the other end of base 36. In a manner presently to be described, rolling the toy backwards to rotate wheels 44 in a clockwise direction will wind the spring of the spring driven motor unit 30. As indicated in FIGS. 6 and 7, roller means 18 is closely received within a hollow compartment 46 formed proximate the lower portion of hollow body 12.

Compartment 46 is defined by a generally horizontally extending wall 48 and a pair of longitudinally spaced apart downwardly extending walls 50.

Figure 12:
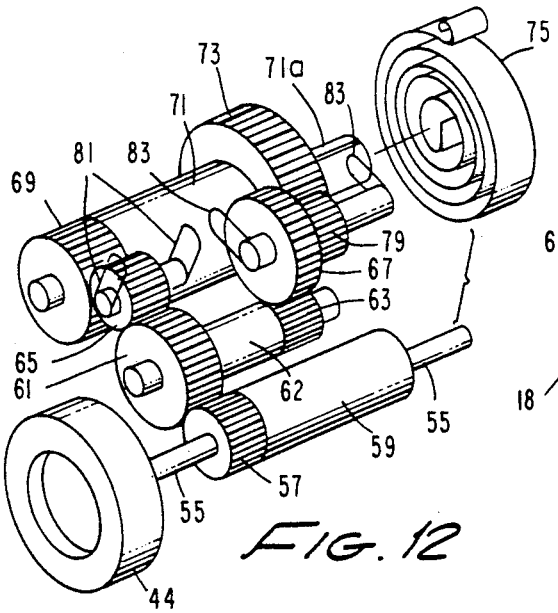
FIG. 12 is a generally perspective view of the cooperating gears of the driving mechanism of the toy.

Turning now to FIG. 12, the component parts of the spring motor, gear drive assembly of the present invention are there shown. One of the previously identified wheels 44 is connected to an axle 55 which, in turn, is connected to a first drive gear 57. Gear 57 is mounted on a drum 59 through which axle 55 extends. Gear 57 is operably coupled with a second gear 61 which is mounted proximate one end of an axle 62. Mounted proximate the other end of axle 62 is a third gear 63. A first slidably movable gear 65 is adapted to mesh with gear 61 while a second slidably movable gear 67 is adapted to mesh with gear 63. Gear 65 is also adapted to mesh with a gear 69 mounted on an axle 71 which also carries a larger diameter gear 73. An extension 71*a* of axle 71 is operably coupled with a coiled spring 75 so that upon rotation of axle 71 in a first direction the coiled spring will be wound. When the coil spring is free to unwind, axle 71 will, of course, be driven in a second, opposite direction. A gear 79, which is companion gear to gear 67, is adapted to mesh with gear 73 in the manner shown in the drawings.

FIGS. 13 through 17 illustrate the winding and driving modes of the spring-wound motor of the apparatus of the invention. Considering first the winding mode shown in FIG. 13, when wheel 44 is rotated in a clockwise direction by pushing the toy backwards, or to the right, as viewed in FIG. 13, gear 57 will be rotated in a clockwise direction which, in turn, will cause gear 61 to rotate in a counter-clockwise direction. As gear 61 rotates in a counter-clockwise direction, it will mesh with slidably movable gear 65 causing gear 65 to rotate in a clockwise direction and to slide downwardly within slots 81

Figure 14:
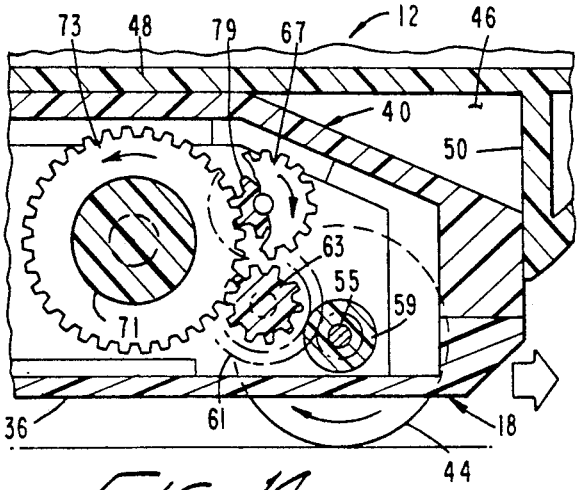
FIG. 14 is an enlarged cross-sectional view taken along lines 14—14 of FIG. 11.

(FIG. 12) into engagement with gear 69 causing gear 69, gear 73 and shaft 71*a* to rotate in a counter-clockwise direction to wind spring 75. Referring to FIG. 14, which also illustrates the winding mode, it is to be noted that when wheel 44 rotates in a clockwise direction, slider gear 67 is moved outwardly within slots 83 so that gear 67 is out of driving engagement with gear 63.

Figure 15:
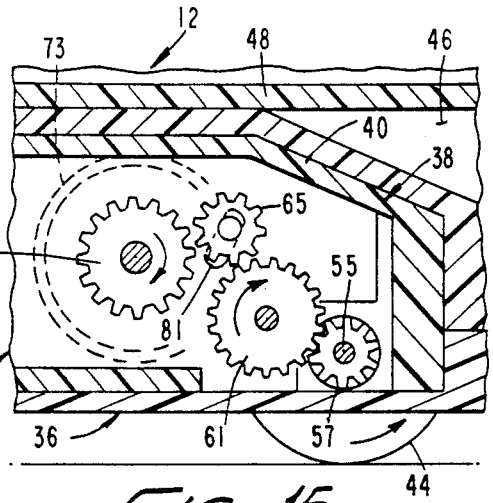
FIG. 15 is a view similar to FIG. 13 but showing the position of the cooperating gears during rotation of the wheels in an opposite direction from that shown in FIG. 13.
Figure 16:
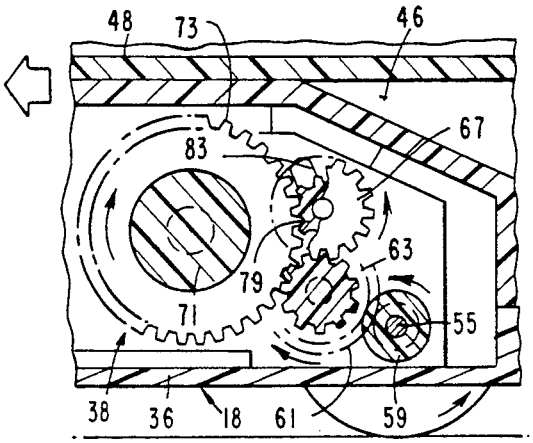
FIG. 16 is a view similar to FIG. 14 but showing the position of the cooperating gears during rotation of the wheels in an opposite direction from that shown in FIG. 14.
Figure 13:
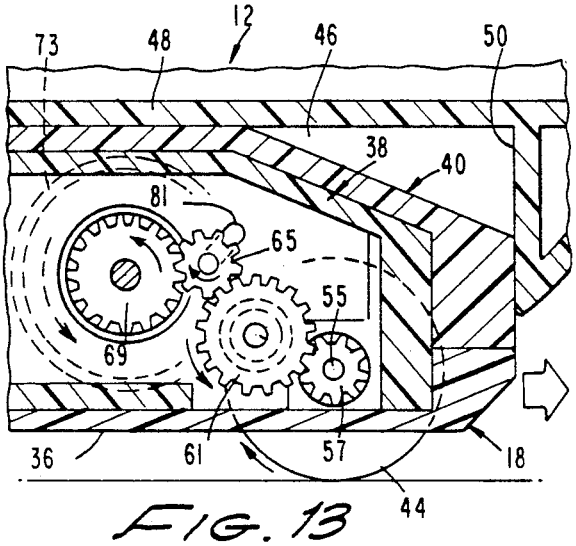
FIG. 13 is an enlarged cross-sectional view taken along lines 13—13 of FIG. 11.
Figure 17:
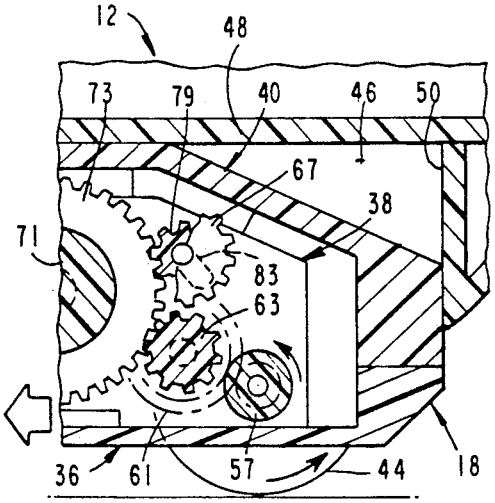
FIG. 17 is a view similar to FIG. 16 but showing the position of the cooperating gears during forward movement of the toy of the invention.

Turning now to FIGS. 15 and 16 which illustrate the driving mode, when rearward movement of the toy ceases upon the complete winding of spring 75 and the toy is released, wheels 44 will be caused to rotate in a counter-clockwise, or forward toy driving direction as spring 75 unwinds. More particularly, as noted in FIG. 16, when gear 73 is driven by spring 75 in an unwinding, clockwise direction, gear 67 drives gear 63 and gear 61 in a clockwise direction (see also FIG. 15). This movement of gear 61 urges slidably movable gear 65 to move upwardly within slots 81 out of driving engagement with gear 69. At the same time, as shown in FIG. 16, counter-clockwise rotation of gear 67 causes clockwise rotation of gear 63 which also causes clockwise rotation of gear 61. As shown in FIG. 15, this causes counter-clockwise rotation of gear 57, axle 55 and wheel 44. As wheels 44 are driven, the toy will, of course, be propelled forwardly, or to the left as viewed in FIG. 16. As illustrated in FIG. 17, as the toy moves forwardly, slider gear 67 moves into a "free wheeling" configuration wherein gear 67 is out of engagement with gear 63 thereby allowing the toy to continue its forward motion with the inertia provided by the unwinding of spring 75.

Figure 3:
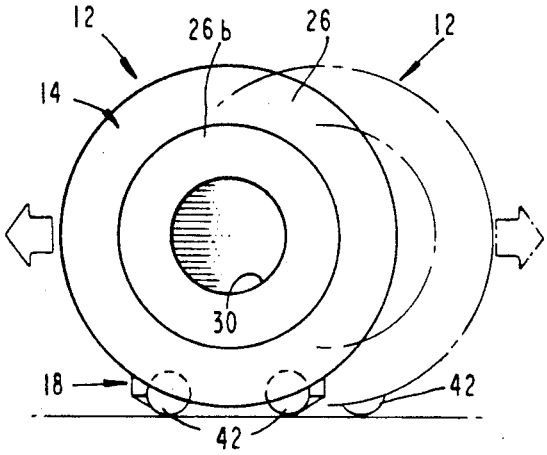
FIG. 3 is a side elevational, generally diagrammatic view showing the manner in which the driving spring of the toy is wound.
Figure 4:
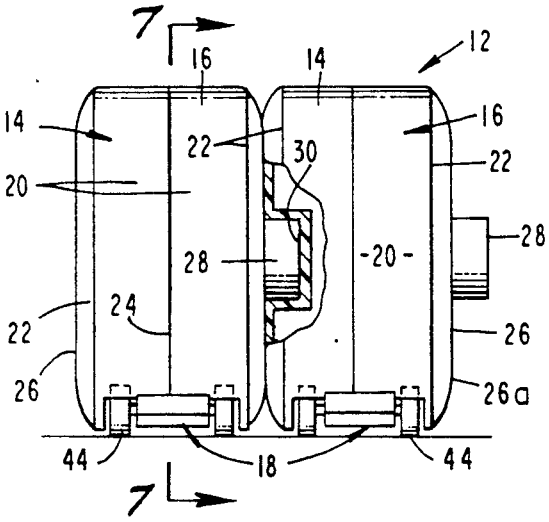
FIG. 4 is a front view showing two of the toys of the invention coupled together.
Figure 5:
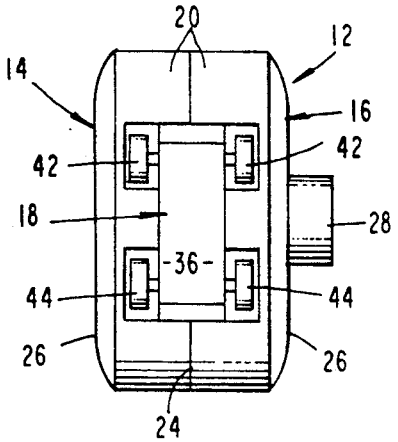
FIG. 5 is a bottom view of the toy.

In using the toy of the invention, a single unit of the character shown in FIGS. 1 and 2 can be rolled to the right as shown in FIG. 3 to wind the spring motor. When the motor is wound and the toy released, it will be propelled rapidly to the left as shown in FIG. 3. If desired, one toy can be coupled with a second toy by inserting the hub 28 of one toy into the socket 30 of an identical toy in the manner shown in FIG. 4.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A rolling toy comprising:

(a) a hollow body, including first and second portions, each said portion including a cylindrical portion being generally circular in shape and having an interrupted peripheral wall defining first and second transversely spaced apart circular edges and a generally disc shaped closure wall connected to said second edge of said peripheral wall, one of said disc shaped walls having an outwardly protruding cylindrically shaped hub and the other of said disc shaped walls having a centrally disposed socket;

(b) means for interconnecting said first and second portions of said hollow body proximate said first edges of said peripheral walls;

(c) roller means connected to said body for rollably supporting said body, said roller means comprising:

(i) a carriage receivable within said interrupted peripheral walls of said first and second portions and at least two wheels rotatably mounted on said carriage; and (ii) motor means carried by said carriage for rotating at least one of said wheels, said motor means comprising gearing means operably connected to said wheel for imparting rotation thereto and spring means connected to said gearing means for driving said gearing means.

* * * * *